United States Patent [19]

Woodhouse et al.

[11] 4,106,435

[45] Aug. 15, 1978

[54] APPARATUS FOR MARKING METAL

[75] Inventors: Eric Douglas Woodhouse, East Kilbride; Alexander Murray Lawrie, Paisley; Thomas McNeil, East Kilbride, all of England

[73] Assignee: Hilti Aktiengesellschaft, Furstentum, Liechtenstein

[21] Appl. No.: 559,438

[22] Filed: Mar. 18, 1975

[30] Foreign Application Priority Data

Mar. 19, 1974 [GB] United Kingdom ..... 12055/74

[51] Int. Cl.[2] ..... B05B 15/04; B05C 5/00

[52] U.S. Cl. ..... 118/301; 101/112; 118/323

[58] Field of Search ..... 118/301, 302, 323; 101/112, 121, 122

[56] References Cited

U.S. PATENT DOCUMENTS

| | | | |
|---|---|---|---|
| 746,786 | 12/1903 | Burdick | 101/122 X |
| 2,884,853 | 5/1959 | Cantoni | 101/112 |
| 3,143,960 | 8/1964 | Naczynski | 118/301 X |
| 3,251,341 | 5/1966 | Eburn, Jr. et al. | 118/302 |
| 3,252,411 | 5/1966 | Black | 101/124 |
| 3,399,649 | 9/1968 | Kidgell et al. | 118/301 X |
| 3,498,260 | 3/1970 | Dejean et al. | 118/301 X |
| 3,735,725 | 5/1973 | Petrikovsky | 118/301 X |
| 3,919,967 | 11/1975 | Warning et al. | 118/301 X |

*Primary Examiner*—John P. McIntosh

*Attorney, Agent, or Firm*—Toren, McGeady and Stanger

[57] ABSTRACT

An apparatus for marking metal in which a main carriage having a spray gun assembly with a stencil assembly mounted on it is moved toward and away from a piece of metal to be marked. Either the spray gun assembly or the stencil assembly is movable relative to the other in a direction transverse to the direction of movement of the main carriage. The stencil assembly has a plurality of stencil rings each having a plurality of cutouts with each ring being indexable so as to bring a specific cutout next to the piece of metal to be marked. After the indexing operation, the spray gun assembly is activated to spray molten metal through a cut-out in each stencil ring for forming the indicia.

15 Claims, 5 Drawing Figures

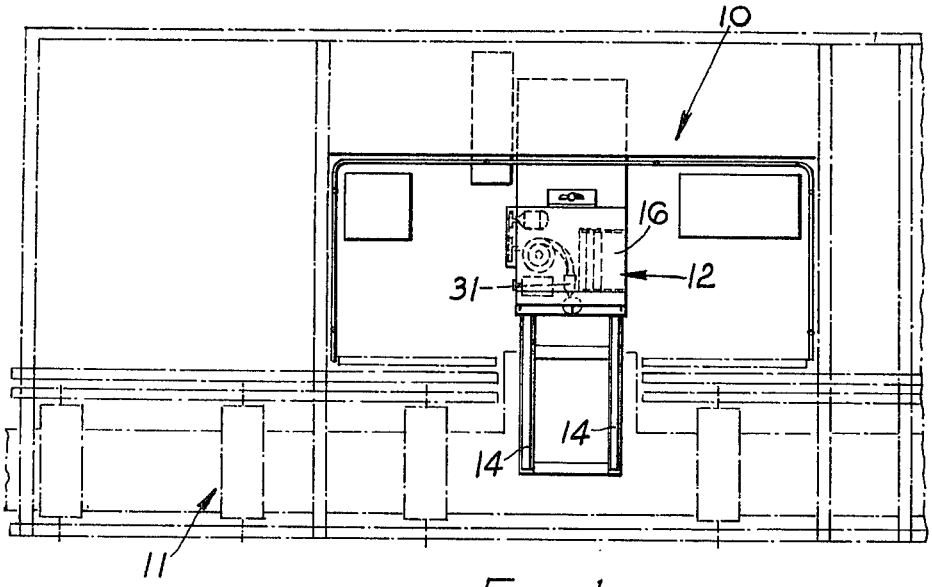
Fig. 1.
Fig. 3.
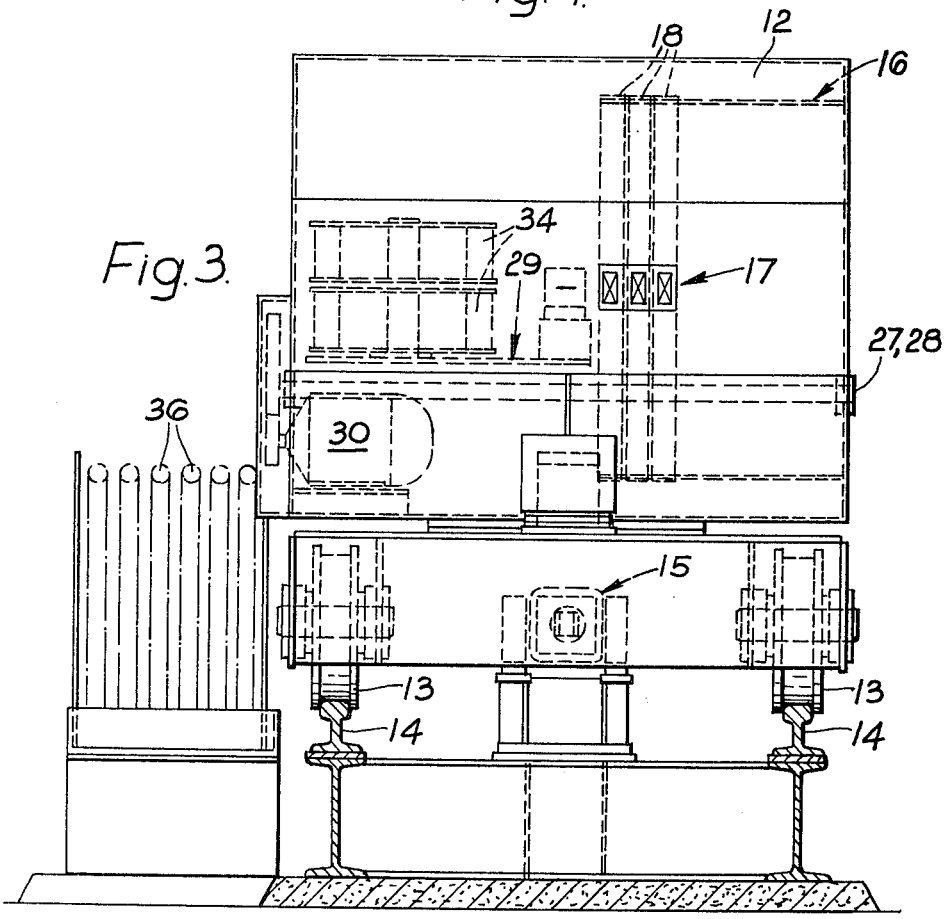

APPARATUS FOR MARKING METAL

This invention relates to the marking of metal, particularly before or during its processing in a rolling mill.

It is essential, of course, to mark pieces of metal, for example steel sheets, before they are passed through a rolling mill or other processing plant, in order that each piece can be identified during and after processing. It is often not feasible to work pieces of metal with paint, dye or the like because heat treatment can cause such markings to become illegible. In the case of large blocks or bars of steel it is known to overcome this problem by attaching a metallic tag to each block by means of a nail from an explosive actuated fastener driving tool. However this method is not suitable for thin sheets, in which case the nail would have insufficient metal to grip and might interfere with the sheet's progress through rollers or the like.

It is an object of the present invention to provide apparatus for marking metal, both hot and cold, particularly steel sheets, which do not have the drawbacks of the above discussed methods.

Accordingly the invention provides apparatus, for marking a surface of a piece of metal, comprising a molten metal spray gun assembly and a stencil assembly comprising a plurality of side-by-side arranged groups of stencils each being indexable to bring a selected one thereof to an operative position, one of the assemblies being movable transversely of the direction of indexing to enable marking to be effected by metal from the spray gun passing through those stencils which are in the operative position onto the surface whilst there is no relative movement between the stencil assembly and the surface.

Preferably the spray gun assembly traverses the stencils sequentially, sprayed metal passing through each stencil forming an individual indicium on the surface.

Each group of stencils can be arranged in an endless chain disposed in a plane extending transversely to the direction of travel of the spray gun. Alternatively the stencil indicia can be cut into a solid stencil ring.

As an alternative to moving the spray gun the stencil assembly can be positioned close to a surface of a moving piece of metal, and moved in synchronism therewith past the spray gun assembly.

The invention also provides apparatus for marking a surface of a piece of metal wherein a stencil assembly, comprising a plurality of side-by-side arranged groups of stencils each being indexable to bring a selected one thereof to an operative position is maintained close to the surface with no relative movement between the surface and the stencil assembly and molten metal is sprayed from a molten metal spray gun assembly, one of the assemblies being moved transversely of the direction of indexing of the stencils to cause the molten metal to pass through the stencils to form markings on the surface.

The stencil assembly can be moved, in synchronism with a surface of a moving piece of metal to be marked, past the spray gun assembly.

Preferably the apparatus further includes means for applying a release compound to the stencils before each spraying and cleaning the stencils after each spraying.

BRIEF DESCRIPTION OF THE DRAWINGS

The invention will be described further, by way of example, with reference to the accompanying drawing, wherein:

FIG. 1 is a plan view of a preferred embodiment of apparatus conforming to the present invention in position adjacent a conveyor track in a steel rolling mill;

FIG. 3 is an enlarged front view of the apparatus of FIG. 1;

DETAILED DESCRIPTION OF THE INVENTION

A preferred embodiment of apparatus 10 conforming to the invention is suitable for marking sheets, bars, billets, blooms or other pieces of metal which may pass along a roller conveyor track 11 in a steel rolling mill.

Figure 5:
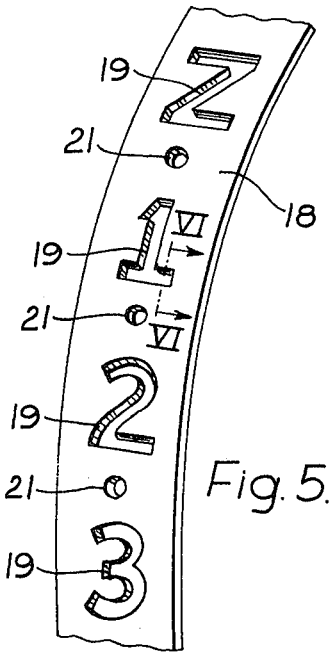
FIG. 5 is an enlarged fragmentary perspective view of a stencil ring of the apparatus.
Figure 6:
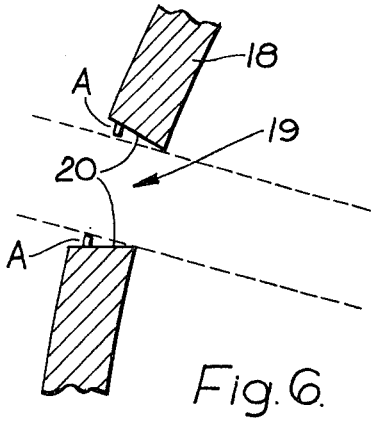
FIG. 6 is a fragmentary cross-sectional view taken on the line VI—VI of FIG. 5.

The apparatus 10 comprises a first main carriage 12 mounted by means of wheels 13 on rails 14. A power cylinder 15 enables the main carriage 12 to be moved along the rails 14 to reach a piece of metal stopped on the track 11 in front of the apparatus 10. Mounted on the main carriage 12 is a cylindrical barrel 16 having a slot therein at the position indicated by reference numeral 17. Around barrel 16 are mounted, for rotation, a plurality of stencil rings 18 (FIGS. 5 and 6).

Each ring 18 is cast from manganese bronze and is about 600 mm in diameter, about 40 mm wide and 5 mm thick. Spaced around each ring 18, at approximately 50 mm intervals, are a plurality of cut-outs 19 defining indicia. Each cut-out 19 is narrower on the inside of the ring 18 than it is on the outside of the ring 18. This minimizes deposit of aluminum thereon (as will be later described) during use. The side faces 20 of the cut-outs 19 are disposed at an angle A, preferably between 2° and 10°, to a line normal to the ring and angle A is advantageously 5°. Between each pair of cut-outs is an indexing aperture 21.

Figure 2:
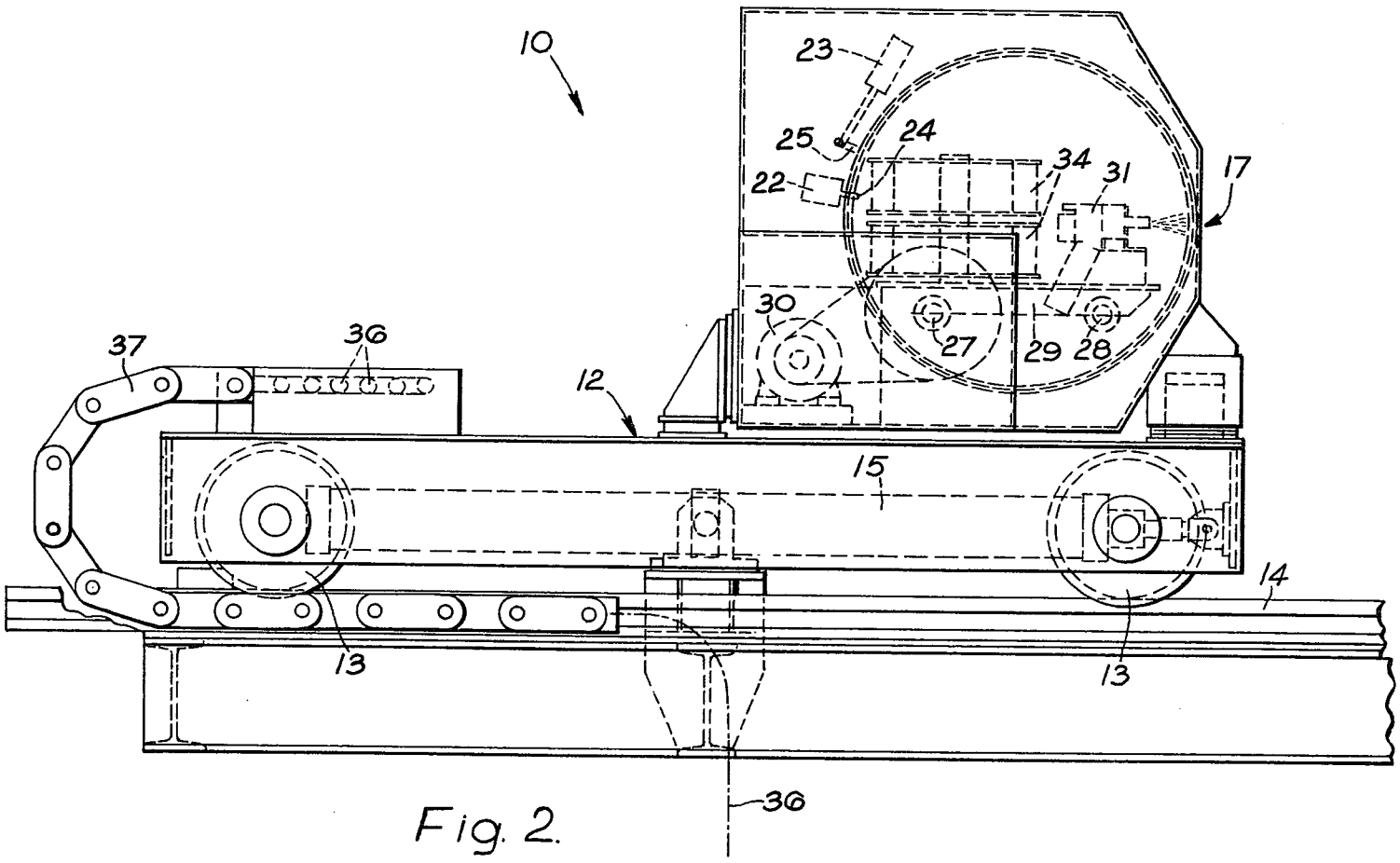
FIG. 2 is an enlarged side view of the apparatus of FIG. 1.

For indexing each ring 18 there is provided a pair of power cylinders 22, 23 (FIG. 2). Each cylinder 22 acts radially of the ring 18 and serves to locate, by a piston rod 24 thereof engaging an apertures 21, each indicium in front of the slot 17 in the barrel 16. A co-operating aperture is provided in the barrel 16. Each cylinder 23 acts at right angles to a radius of the barrel and has a peg 25 attached to its piston rod 26, which peg 25 engages with an adjacent aperture 21 and, upon actuation of the cylinder, serves to rotate the ring 18 by one indicium.

Extending across the main carriage 12, inside the barrel 16, are a pair of bars 27, 28 which support a second, spray carriage 29. The bar 27 is threaded and a captive nut (not shown) on the spray carriage 29 engages therewith. Rotation of the bar 27 by means of an electric motor 30, causes the spray carriage 29 to travel along the bars 27, 28.

The spray carriage 29 has mounted thereon a molten metal spray gun 31, rotary wire brush 32 and a spray head 33 for a release compound. The spray gun 31 is of conventional form and in it a pair of metal wires, preferably aluminum, fed from insulated reels 34 are melted and atomized by forming an arc therebetween and directing a blast of compressed air at the arc to cause the melted metal to issue as a fine spray from the gun. Mounting of the reels 34 on the spray carriage is important because in normal use of a metal spray gun it is necessary to feed the wires through insulated flexible leads from relatively distant reels. To allow for such flexible leads on the spray carriage 29 would be difficult.

The rotary wire brush 32 serves to clean metal from the stencil rings 18 after they have been sprayed and the spray head 33 sprays a release agent onto the rings after brushing. This procedure helps prevent build-up of metal on the stencil rings 18.

Flexible leads 36 for supplying electrical power, compressed air and the like to the main carriage are carried by a carrier chain assembly 37.

The apparatus is operated, in accordance with a preferred method of the invention as will now be described. The stencil rings 18 are first indexed to bring desired indicia to the operative position at the slot 17. If desired the indexing cylinders 22 and 23 can be so controlled that all or some of the rings 18 are indexed, after each spraying, to ensure that pieces of metal have sequential markings applied thereto. The cylinder 15 is then actuated to move the main carriage 12 into a position wherein the slot 17 is in close proximity to the surface of a piece of metal on track 11. It is desirable that the rings 18 should be as close as possible to the surface of the metal to be marked.

Figure 4:
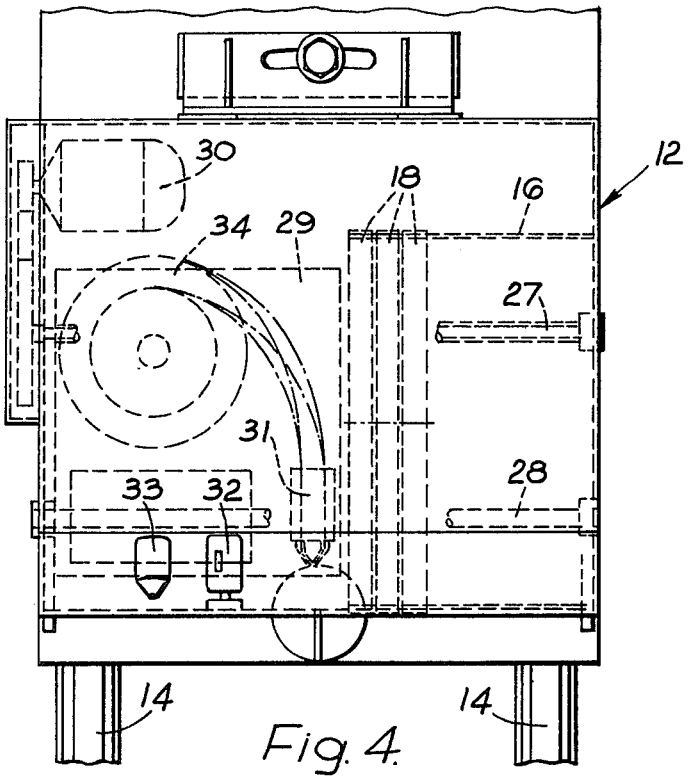
FIG. 4 is an enlarged plan view of a main carriage of the apparatus of FIG. 1.

Next, the motor 30 is started to move the spray carriage 29 to the right in FIG. 4, and the metal spray gun 31 is actuated to spray molten aluminum through the cut-outs in stencil rings 18 as it passes them. The brush 32 is subsequently actuated to clean the stencils 18 by following in the wake of the gun 31 and brushing off any aluminum which has adhered to the stencils. After the brush 32 comes spray head 33 which sprays a release agent onto the cleaned stencils to facilitate brushing after the next spraying.

The spray carriage 29 is then reversed back to its starting position and the main carriage retracted ready for a new marking operation. All these steps can, of course, be carried out automatically.

The markings produced by the invention are legible and durable and metal marked by the invention can be heated, annealed, rolled and stocked without the markings becoming illegible.

The invention is not limited to the precise details of the foregoing and variations can be made thereto within the scope of the following claims. For example, metal other than aluminium, or aluminium alloys, can be used in the spray gun. The brush 32 and spray head 33 can be dispensed with and replaced by alternative cleaning means such as scrapers and/or fluid blasts. The sequence of cleaning can be changed to occur during retraction of the spray carriage or during a separate cleaning traverse of the spray carriage when the spray gun is inoperative.

Figure 7:
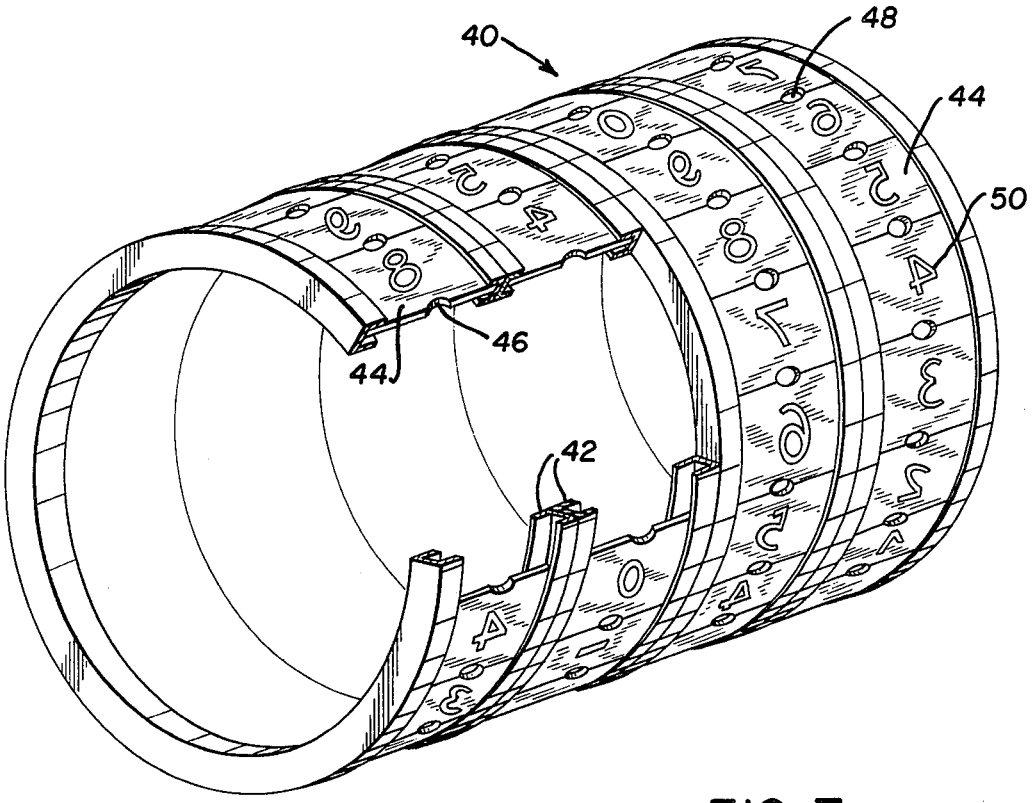
FIG. 7 is a perspective view partly cut away illustrating an alternative embodiment of the invention.

The stencils need not be in the form of the described rings 18. For example, transversely of the direction of travel of the carriage can be disposed a number of side-by-side tracks 40, note FIG. 7. Each track can comprise a pair of opposed U-section members 42 parallel to each other and in the form of an oval or circular loop. In each track 40 a respective plurality of stencils 44 is arranged each in the form of a rectangular metal sheet, side portions of each being received in the U-section members and each end portion of each stencil having a semi-circular cut-out 46 to form, with an adjacent stencil, a circular recess 48 for engagement by an indexing mechanism. The stencils 44 in each group are slidable in the track as an endless chain and can be moved by the indexing mechanism to move a selected one into an operative position wherein it is generally vertical at one end of the loop. Each stencil 44 can have a cut-out 50 shaped to form an indicium when material is sprayed thereon.

Instead of the spray gun traversing the stencils the spray gun can be fixed and the stencils mounted to move in synchronism with a piece of metal passing the apparatus whilst the spray gun sprays molten metal therethrough. This obviates the need to stop the piece of metal at the apparatus.

The apparatus can, of course, be adapted to apply markings to an upper or lower horizontal surface of a piece of metal.

We claim:

1. Apparatus for applying an identifying marking on the surface of a piece of metal, comprising a molten metal spray gun assembly and a stencil assembly, said stencil assembly including a plurality of side-by-side arranged stencilling members each having an inner surface and an oppositely disposed outer surface with a plurality of serially arranged cut-outs extending from said inner surface to said outer surface and each said cutout defining an indicium, and first means for moving each said stencilling member for locating at least certain selected ones of said cut-outs formed in said stencilling member in an operative position, second means for moving one of said spray gun assembly and stencil assembly transversely of the direction of movement of said stencilling members by said first means for marking the piece of metal by spraying metal from said spray gun assembly through the cut-outs located in the operative position with the sprayed metal passing first through the inner surface and then the outer surface onto the surface to be marked.

2. Apparatus as claimed in claim 1 wherein the spray gun assembly includes a spray gun, and feed coils for wire for the spray gun.

3. Apparatus as claimed in claim 2 wherein said second means is arranged for moving said spray gun assembly relative to the stencil assembly.

4. Apparatus as claimed in claim 3, wherein said second means comprises a spray carriage and a pair of laterally spaced bars, said spray carriage supporting said spray gun assembly being mounted on and reciprocable along said bars transversely of the direction of indexing of the stencils.

5. Apparatus as claimed in claim 4, wherein one of said bars is threaded and is arranged for threaded engagement with a member secured on the carriage, such as a captive member, whereby rotation of the threaded bar serves to traverse the spray carriage.

6. Apparatus as claimed in claim 1 wherein said first means moves said stencil assembly relative to the spray gun assembly.

7. Apparatus as claimed in claim 1, wherein said stencil assembly comprises a cylindrically shaped barrel having a slot extending in parallel relation with the axis of the barrel at the operative position, and each said stencilling member comprises a stencil ring mounted for rotation about the barrel and having a plurality of serially arranged said cut-outs defining indicia.

8. Apparatus as in claim 7, wherein each said stencil ring includes apertures provided one between each adjacent pair of cut-outs.

9. Apparatus as claimed in claim 8, wherein said first means comprises an indexing mechanism associated with each said stencilling member, said mechanism comprising a first power cylinder displaceable normally of the direction of the serial arrangement of said cut-outs and serving to engage one of the apertures to lock said stencilling member during spraying, and a second power cylinder displaceable at right angles to the first cylinder and operable to engage one of said indexing apertures to effect the location of one of said cut-outs in the operative position.

10. Apparatus as in claim 7, wherein each cut-out is narrower on the inner surface adjacent the spray gun assembly than it is on the outer surface remote from the spray gun assembly.

11. Apparatus as claimed in claim 10, wherein the side faces of each cut-out lie at an angle of from 2° to 10° to a normal to the stencil.

12. Apparatus as claimed in claim 11, wherein the side faces of each cut-out lie at an angle of 5° to a normal to the stencil.

13. Apparatus as claimed in claim 1, wherein said stencil assembly comprises a plurality of side-by-side tracks, each comprising a pair of opposed U-section members parallel to each other, and each said track accommodates one of said stencilling members, said stencilling members each comprising a plurality of serially arranged rectangular sheets each having a cut-out therein defining an indicium, each said sheet having a pair of opposite side portions and a pair of opposite end portions and said side portions being accommodated in the U-shaped members and each said end portion of each said sheet having a recess cut therein, each recess forming with a complementary recess in the adjacent said sheets, an aperture between adjacent said cut-outs for locating said cut-outs in the operative position.

14. Apparatus as claimed in claim 13, wherein each of said tracks is in the form of a loop.

15. Apparatus as claimed in claim 1 further comprising a main carriage having said spray gun assembly and said stencil assembly mounted thereon, said main carriage being reciprocable back and forth relative to the piece of metal to be marked and transversely of the direction of movement of said first means and said second means so as to bring said stencil assembly into close proximity with the surface of the piece of metal to be marked.

* * * * *